United States Patent [19]

Larson

[11] Patent Number: 4,805,808

[45] Date of Patent: Feb. 21, 1989

[54] CONTAINER AND LIQUID DISPENSER

[75] Inventor: Raymond L. Larson, Fargo, N. Dak.

[73] Assignee: BMR Investments, Inc., Fargo, N. Dak.

[21] Appl. No.: 55,440

[22] Filed: May 29, 1987

Related U.S. Application Data

[63] Continuation of Ser. No. 19,342, Feb. 26, 1987, and Ser. No. 940,842, Dec. 11, 1986, and Ser. No. 906,156, Sep. 11, 1986.

[51] Int. Cl.[4] ..... B67D 5/60

[52] U.S. Cl. ..... 222/185; 222/466; 215/1 C; 220/94 A

[58] Field of Search ..... 222/465.1, 466, 475, 222/468, 185, 146.6; 215/1 C, 100 A; 220/94 A; D9/374, 376, 378–383, 395–396

[56] References Cited

U.S. PATENT DOCUMENTS

| | | | |
|---|---|---|---|
| Re. 25,316 | 1/1963 | Stenger et al. . | |
| D. 106,061 | 9/1937 | Reeves . | |
| D. 171,528 | 2/1954 | Canter . | |
| D.194,069 | 11/1962 | Houghton . | |
| D. 194,631 | 2/1963 | Eicholtz | D9/376 |
| D.197,918 | 4/1964 | Petitto . | |
| D. 209,929 | 1/1968 | Plummer . | |
| D. 214,973 | 8/1969 | Amand . | |
| D. 227,654 | 7/1973 | Byrne . | |
| D. 233,134 | 10/1974 | Sinding . | |
| D. 235,310 | 6/1975 | Betka . | |
| D. 243,121 | 1/1977 | Ralston, Jr. et al. . | |
| D. 244,427 | 5/1977 | Schieser et al. . | |
| D. 244,990 | 7/1977 | Anderson . | |
| D. 275,734 | 10/1984 | Voice . | |
| D. 280,709 | 9/1985 | Waring . | |
| D. 282,957 | 3/1986 | Carlson | D9/374 X |
| D. 284,033 | 5/1986 | Brodsky . | |
| D. 288,293 | 2/1987 | Arvans | D9/378 X |
| 2,635,604 | 4/1953 | Fredrickson . | |
| 3,195,752 | 7/1965 | Cox | 215/1 C |
| 3,341,047 | 9/1967 | Nauta . | |
| 3,537,498 | 11/1970 | Amand | 215/100 A |
| 3,717,277 | 2/1973 | Stengle, Jr. | 215/100 A |
| 4,391,308 | 7/1983 | Steiner | 222/325 X |
| 4,629,096 | 12/1986 | Schroer et al. | 222/146.6 |
| 4,658,975 | 4/1987 | Cone | 222/465.1 |

FOREIGN PATENT DOCUMENTS

| | | | |
|---|---|---|---|
| 1465560 | 12/1966 | France | 222/466 |
| 110547 | 1/1965 | Netherlands | 222/465.1 |

OTHER PUBLICATIONS

Reid Value Company, Inc. brochure.

Consumer Reports, Jan. 1987, pp. 42–48.

*Primary Examiner*—Charles A. Marmor

*Attorney, Agent, or Firm*—Burd, Bartz & Gutenkauf

[57] ABSTRACT

A flexible and disposable water bottle adapted to be used with water coolers and dispenser has a generally cylindrical body joined to a conical neck and a flat base. A removable cap threaded on the upper end of the neck closes the opening into the chamber of the bottle. The neck has an inwardly directed shoulder engageable with an annular seal mounted on a dispenser when the bottle is in the inverted installed position. The shoulder is positioned in annular surface sealing engagement with the seal. The side and base of the bottle have normally disposed handles to facilitate the mounting of the bottle on the dispenser.

24 Claims, 5 Drawing Sheets

CONTAINER AND LIQUID DISPENSER

CROSS REFERENCE TO RELATED APPLICATION

This application is a continuation-in-part of U.S. Application Ser. No. 906,156 filed Sept. 11, 1986; U.S. Application Ser. No. 940,842 filed Dec. 11, 1986; and U.S. Application Ser. No. 019,342 filed Feb. 26, 1987.

FIELD OF INVENTION

The invention relates to low cost disposable containers and bottles adapted to store liquids, such as water, carbonated water, and beverages useable in dispensers and coolers.

BACKGROUND OF INVENTION

Drinking water in urban areas of North America are treated with chlorine as the primary disinfectant. Chlorine produces by products, such as THMs, that can be harmful to human health. Ozone and chlorine dioxide are being used as substitutes for chlorine in the water treatment process for muncipal water supplies. Many persons prefer water and beverages derived from their natural source or have not been treated with chlorine or ozone or like chemicals. A substantial market for bottled water and beverages has been developed. Water dispensers and coolers are common in the home and work place. The water is stored and transported in five gallon polycarbonate and glass bottles that are used with the dispensers and coolers. These bottles have a generally cylindrical body and a dome shaped top. The top terminates in a neck having an opening normally closed with a removable cap. The prior containers for water dispensers and coolers have disadvantages in that they are costly and are designed for the returnable and re-usable market. One problem with the glass bottle is that it is bulky, cumbersome, and heavy and is susceptible to fracture and breakage. The prior bottles lack suitable handles making them difficult to manuever and place into the dispensers. The mobility storage and installation of these bottles is inconvenient and arkward. The cost of using a re-usable polycarbonate and glass bottles is unnecessarily high as the majority of the costs are contained in the delivery services. The polycarbonate and glass bottles are rigid structures that do not automatically conform to the shape of a sealing ring on a dispenser. This may cause an improper seal and allow contaminates to enter the drinking water. The container for liquid, such as water, and like beverages of the invention overcomes the disadvantages of the prior reusable water bottles.

SUMMARY OF INVENTION

The invention is directed to a container for drinking water usable with water dispenser and cooler. The container is a lightweight disposable water bottle that is readily installed on a dispenser. The bottle has handle structure that facilitates the handling and placing of the bottle on a dispenser. The neck of the bottle has a shoulder that rests on an annular sealing ring of the dispenser to retain the shoulder in sealing relation with the sealing ring and maintain the bottle on the dispenser.

An embodiment of the container comprises a one-piece plastic disposable bottle having a continuous generally cylindrical side wall joined to a base and an upwardly directed generally conical neck. The neck terminates in a threaded tubular end surrounding an opening into the chamber of the bottle. A cap threaded on the tubular end normally closes the opening. The bottle is provided with handle means to facilitate the carrying and installation of the bottle unto a dispenser. The handle means includes a first generally upright hand grip member or bar integral with the side wall of the bottle. A recess in the side wall provides an opening between the handle and the side wall to accommodate the fingers of the hand. The base of the bottle has a second handle that is normally disposed relative to the first handle. A recess in the base provides an opening between the second handle and the base to accommodate the fingers of the hand so that the handle can be readily gripped with the hand. The first and second handles are located in generally the same vertical plane passing through the central longitudinal axis of the bottle. The first and second handles each have a longitudinal axis that is normally disposed relative to each other.

An annular groove circumvents the side wall of the bottle between the first and second handles. The groove is formed by a continuous circular recessed band forming part of the side wall. The band reinforces the lower portion of the side wall of a bottle when it is in its normal upright position. The band also minimizes the collapse of the bottle when it is inverted on the dispenser. A number of spaced bands can be incorporated into the side wall of the bottle.

The neck of the bottle has an annular flexible shoulder located adjacent the upper end of the side wall. The shoulder is positioned in a surface annular sealing engagement with the top of the sealing ring of the dispenser. The shoulder conforms to the shape of the sealing ring and allows the neck of the bottle to nest into the ring to firmly support the bottle on the dispenser. The bottle remains on the dispenser during the withdrawal of the water from the bottle and the replacement of the water in the bottle with air. When the bottle is empty, it is appropriately disposed of and replaced with a new bottle full of water.

These and other advantages of the bottle of the invention are contained in the bottles shown in the drawings and described in the following detailed description thereof.

DESCRIPTION OF PREFERRED EMBODIMENTS

Figure 1:
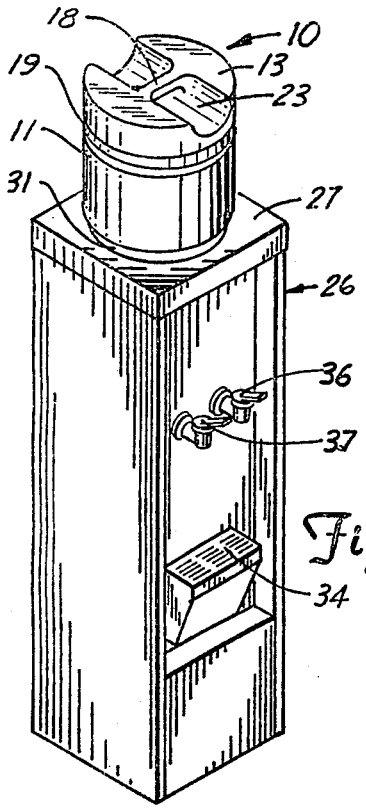
FIG. 1 is a front perspective view of a water dispenser accommodating a disposable container of the invention.
Figure 2:
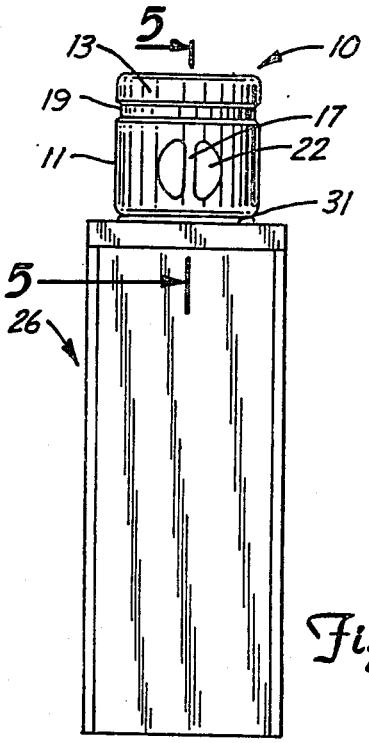
FIG. 2 is a side view of the right side of FIG. 1.
Figure 3:
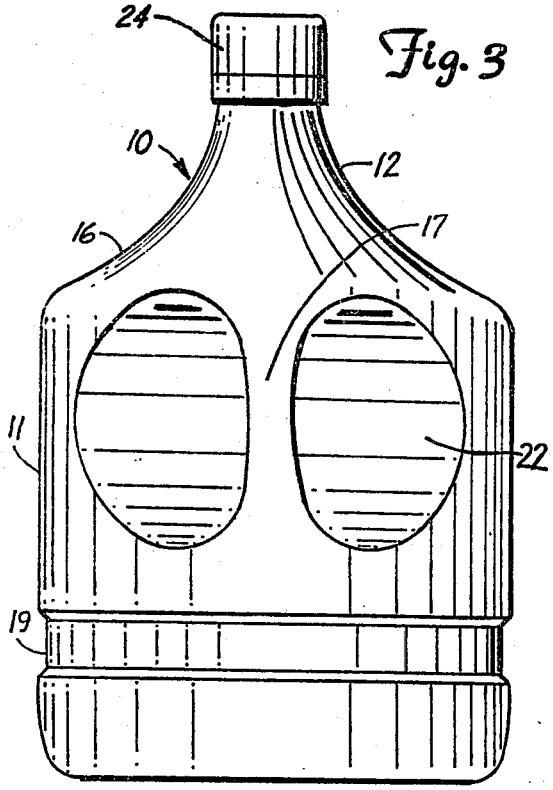
FIG. 3 is an enlarged side elevational view of the disposable container.

Referring to FIGS. 1 to 5, there is shown the disposable container of the invention indicated generally at 10 for use with a water dispenser 26. Water dispenser 26 can be a water cooler. The dispenser 26 also can be equipped with a heater whereby hot water can be obtained therefrom and a chiller to cool the water. Other types of liquids and dispensers can be used with the containers of this invention.

Container 10 is a one-piece low cost plastic water bottle having a capacity between 1 and 4½ gallons. Preferably, the water bottle is of a size to have a capacity of 2½ gallons of water. The container 10 is preferably used to store liquid 38, such as drinking water. Other types of liquids, such as non-carbonated water, mineral water, carbonated water with natural flavoring, purified water, distilled water, and like beverages can be stored in the bottles. The bottles are preferably made of polyethelene plastic by conventional blow molding procedures. Container 10 described herein has a cylindrical side wall. The container of the invention can have other side wall shapes, such as square, triangular, pentagonal, hexagonal, and octagonal. Examples of these containers are shown in U.S. Application Ser. No. 940,842. This application and containers disclosed therein are incorporated by reference.

As shown in FIGS. 3 to 7, container 10 has a generally cylindrical body 11 joined to a generally circular bottom or base 13 and an upwardly directed conical shaped upper wall or neck 12. Neck 12 slopes upwardly and terminates in an annular threaded tubular end 14. End 14 has an opening 15 that is the sole entrance and exit into chamber 21 of container 10. Neck 12 is joined to the body 11 with an annular flexible shoulder 16. A cap 24 is normally threaded on the end 14 to close opening 15. In use, cap 24 is removed so that the water in container 10 can flow into a dispenser or be poured into a glass or cup.

Figure 4:
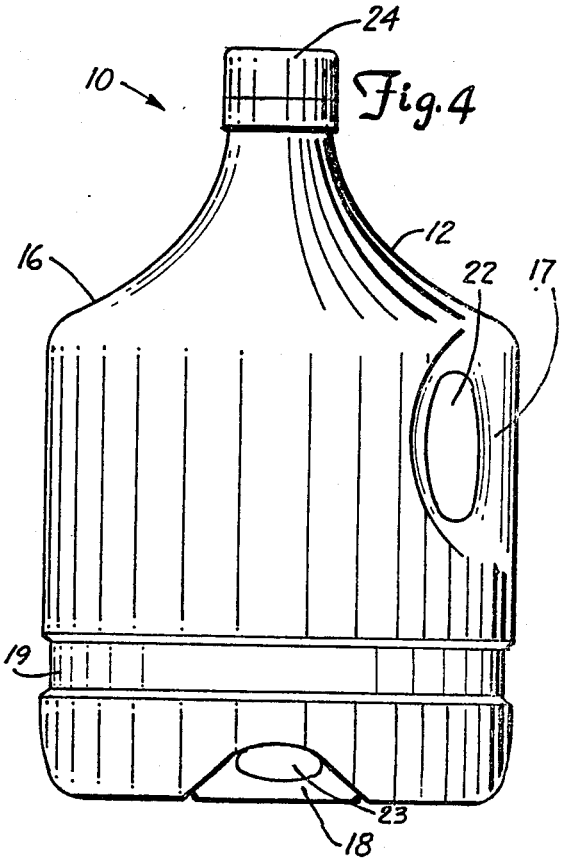
FIG. 4 is a left side view of FIG. 3.

A first handle 17 is incorporated in side wall 11 of the body 11 adjacent shoulder 16. Handle 17 extends in an upward direction. The opposite ends of the handle are integral with the side wall. The middle portion of handle 17 is separated from the side wall with a chordal recess 22. Recess 22 is of a size sufficient to accommodate the fingers of the hand so that the hand can grip handle 17. A second handle 18 is incorporated in base 13. Handle 18 spans an upwardly directed recess 23 in base 13. Recess 23 is of a size to accommodate the fingers of a hand so that the hand can grip handle 18. Handles 17 and 18 are normally disposed to each other and are located in a common vertical plane that extends along the longitudinal central axis of container 10. Handle 17 has a longitudinal vertical axis. Handle 18 has a longitudinal horizontal axis. As shown in FIG. 4, the recesses 22 and 23 extend in the same transverse direction and are normally disposed relative to each other. Handle 18 does not interfere with the resting of the container on a flat surface since handle 18 is in general transverse alignment with the bottom of base 13. Handles 17 and 18 are used to facilitate the manual manipulation of container 10.

Figure 5:
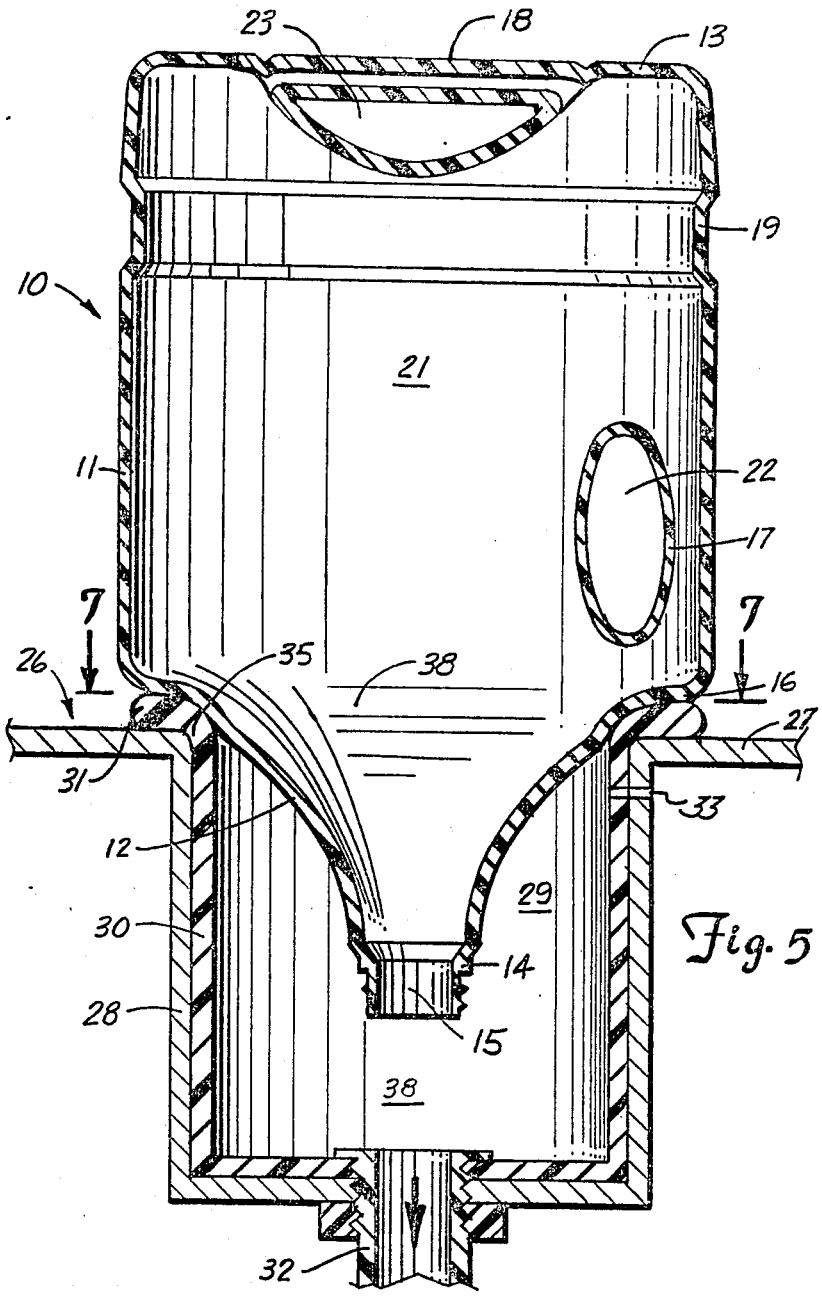
FIG. 5 is an enlarged sectional view taken along the line 5—5 of FIG. 2.
Figure 6:
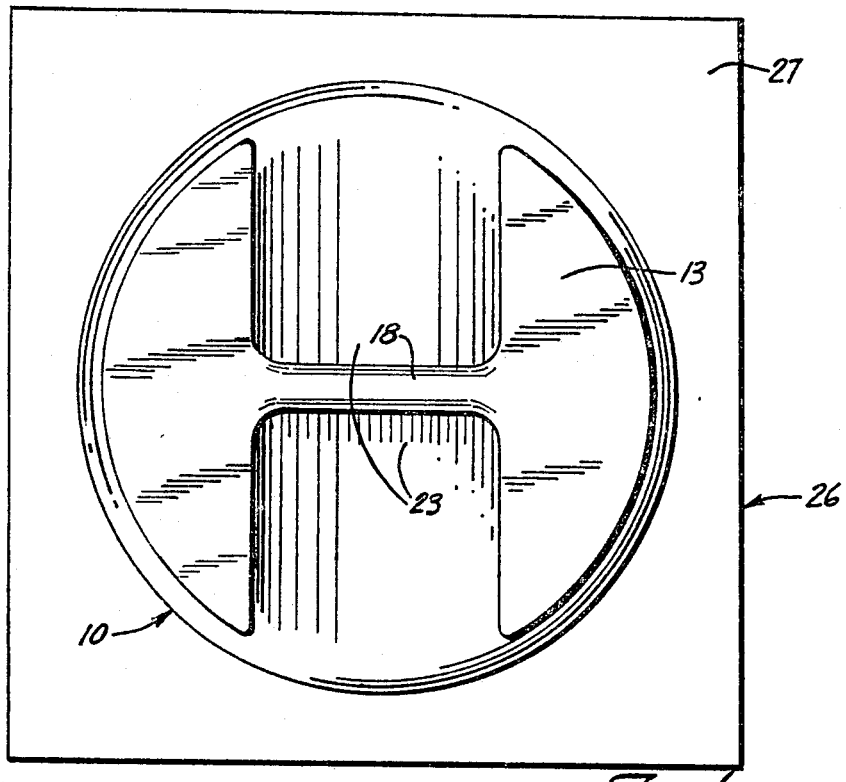
FIG. 6 is an enlarged top view of the dispenser and disposable container of FIG. 1.
Figure 7:
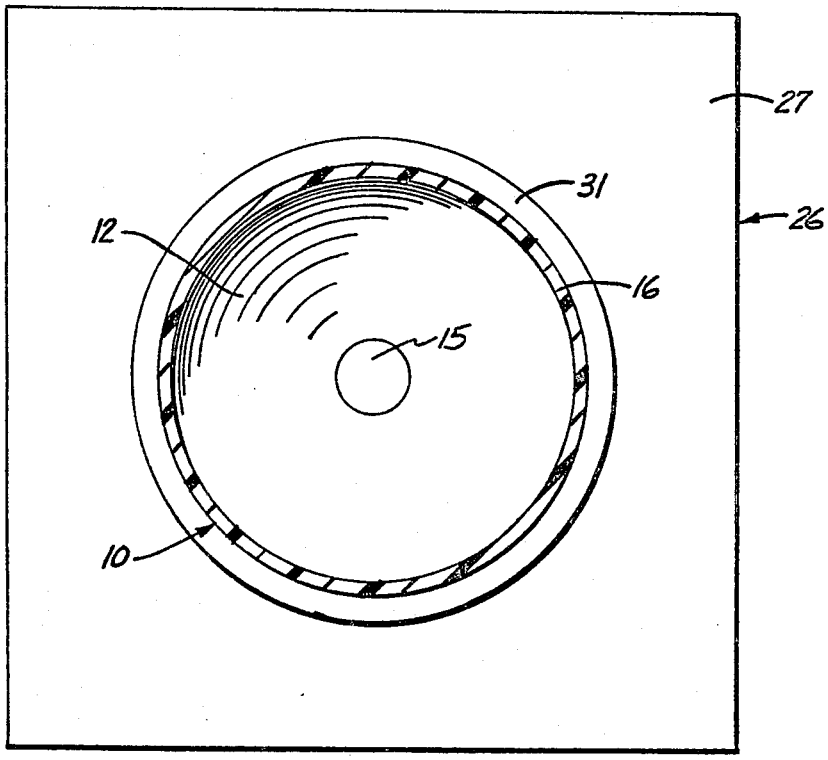
FIG. 7 is a sectional view taken along the line 7—7 of FIG. 5.

Container 10 is usable with a water dispenser indicated generally at 26 having a generally flat top wall 27. The mid-portion of wall 27 has a centrally located dispensing cavity or well 29. As shown in FIG. 5, the well 29 is formed with a cylindrical wall 28 accommodating a liner 30. The upper end of liner 30 is joined to an annular sealing ring 31. Ring 31 is a continuous annular plastic member that inserts into the well 29. Ring 31 extends over the top wall 27 that surrounds the well 29. The sealing ring 31 has a continuous annular convex upper surface adapted to engage annular shoulder 16 of container 10. As shown in FIG. 5, the flexible annular shoulder 16 flexes or bends to conform to the shape of sealing ring 31 to locate shoulder 16 in surface engagement with the upper surface of sealing ring 31. Neck 12 of the container protrudes downwardly into the cavity 29 whereby the water 38 in the container flows into well 29 until the level of the water in well 29 closes the opening 15. Wall 28 and liner 30 have a small opening 33 to allow limited flow of air into well 29 so that air can flow up into the chamber 21 of container 10 when the level of liquid in the well 29 falls below the opening 15. An air filter (not shown) can be located over opening 33 or associated therewith. This allows additional water to flow from chamber 21 into well 29. The water flows through spout 32 to a pair of dispensing valves 36 and 37 having manually operated levers mounted on the front of dispenser 36 as shown in FIG. 1. A receptacle 34 located below valves 36 and 37 collects water that drips and spills. The temperature of the water can be controlled with motorized heating and cooling units (not shown) located inside dispenser 26.

Figure 8:
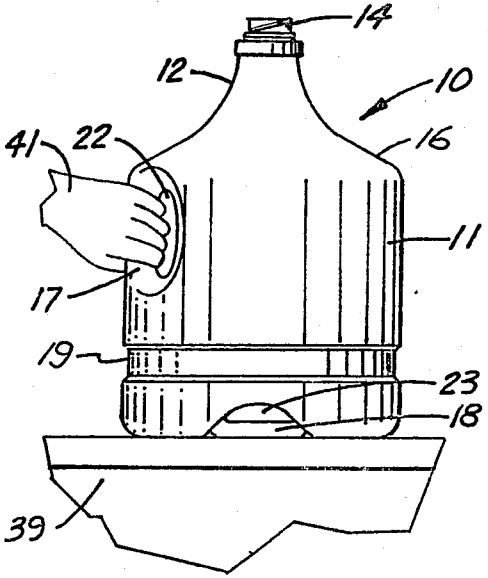
FIG. 8 is a front view of the container supported on a table and being gripped with the left hand.
Figure 9:
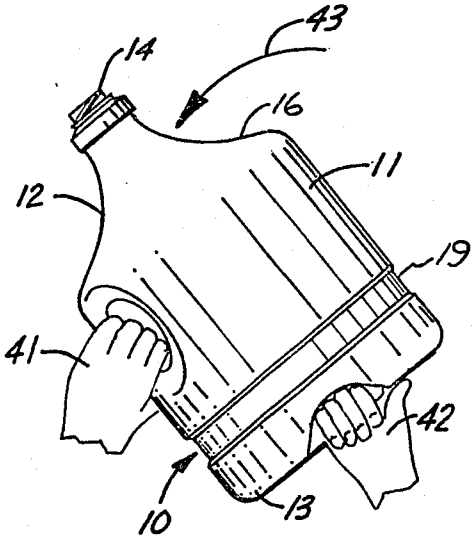
FIG. 9 is a front view of the container being gripped with the right and left hand and moved toward a dispenser.
Figure 10:
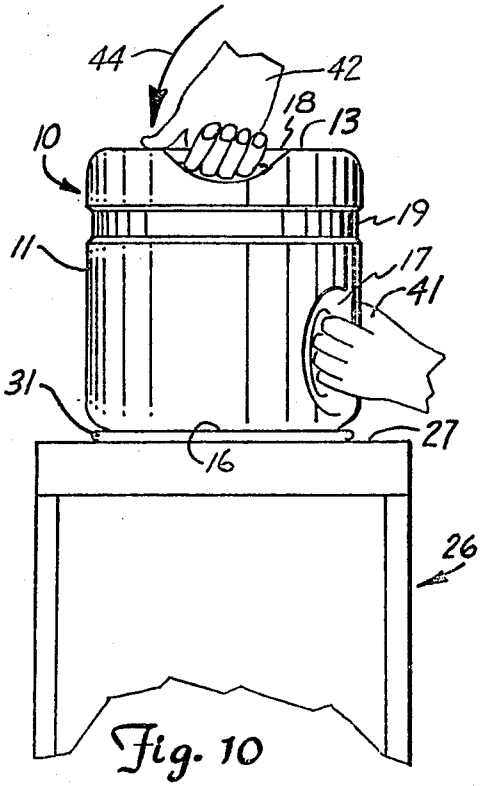
FIG. 10 is a front view of the container being installed in the inverted position onto a dispenser with the right and left hand.

The installation of container 10 on the dispenser 26 is illustrated in FIGS. 8 to 10. With base 13 of container 10 resting on a table or a counter 39, cap 24 is removed from threaded tubular end 14. The left hand 41 of a person grips first handle 17. The fingers of left hand extend through recess 22 and are wrapped around handle 17. The thumb of the left hand 41 is located adjacent base 13. While gripping handle 17, left hand 41 lifts the container 10 off table 39. Right hand 42 of the person then grips the exposed second handle 18 located on the bottom of container 10. The fingers of the right hand 42 extend through recess 23 and are wrapped around the handle 18. The thumb of the right hand 42 is oriented adjacent the handle 18. Finally, container 10 is lifted and inverted as indicated by the arrows 43 and 44 with the concurrent operations of the hands 41 and 42. Container 10 is inserted into the dispenser in an inverted or bottom-up position with an arc-like motion. Annular shoulder 16 is located in surface sealing engagement with the sealing ring 31 located on the top wall 27 of dispenser 26. The force exerted by water 38 in container 10 causes shoulder 16 to flex inwardly so as to form a tight annular surface seal between neck 16 and sealing ring 31. The top surface of sealing ring 31 being convex or rounded insures proper sealing relationship. This prevents foreign materials, particulates, liquids and the like from entering the water dispensing well 29 and contaminating the water therein.

Hands 41 and 42 are then removed from their respective handles 17 and 18 allowing container 10 to rest on the top surface of the annular seal 31. The entire weight of the container and liquid that remains in the container chamber 21 is transferred to seal 31. The flexible plastic of the neck 12 conforms to the curvature of the top surface of the seal providing a surface seal and bearing engagement for container 10.

Figure 11:
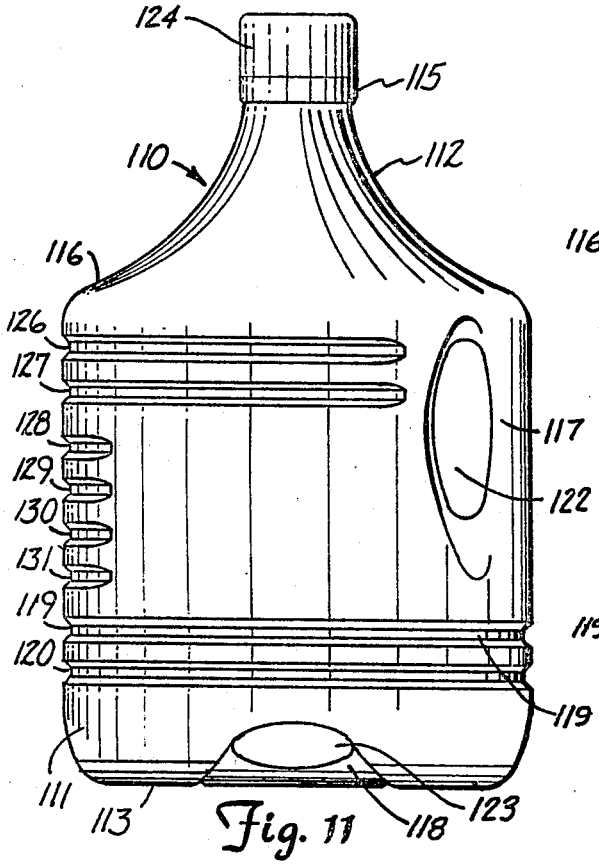
FIG. 11 is an elevational view of a modification of the disposable container of the invention.
Figure 12:
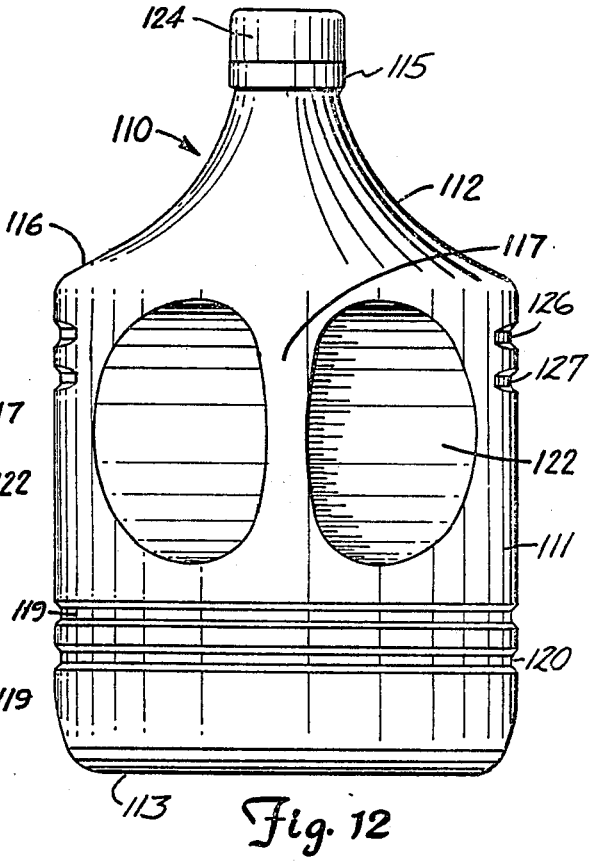
FIG. 12 is a side view of the right side of FIG. 11.
Figure 13:
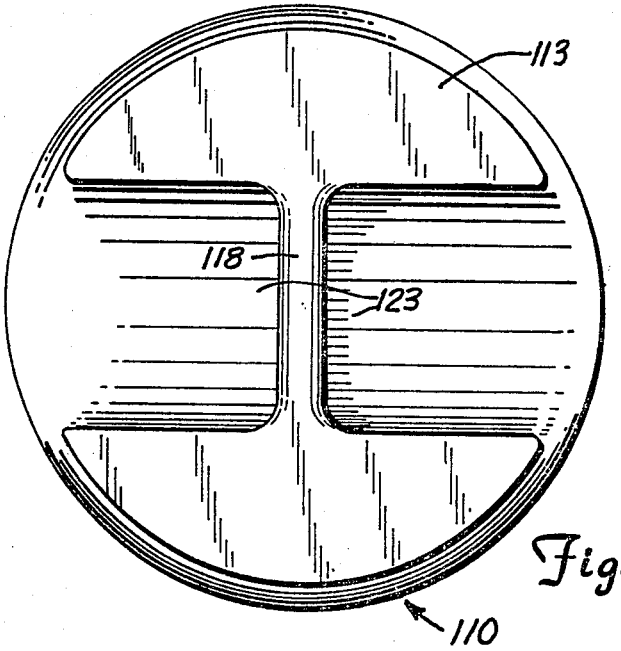
FIG. 13 is a bottom view of FIG. 12.

Referring to FIGS. 11 to 13, there is shown a modification of the container or disposable bottle for storing water of the invention indicated generally at 110. Container 110 is usable with the dispenser 26 to store and dispense water. Container 110 is a one-piece molded plastic structure that is made of low cost disposable material, such as polyethelene. The top of the container is closed with the usual threaded cap 124.

Container 110 has a cylindrical body 111 joined to a generally conical shaped upper wall or neck 112. The bottom of body 111 is joined to a base 113. An annular shoulder 116 joins the upper portion of cylindrical body 111 to the lower portion of the conical neck 112. The plastic material of the bottle is flexible so as to provide a flexible shoulder 16. Shoulder 116 has an annular shape that is complementary to the annular dimension of the top surface of the annular seal 131 on the top wall of the dispenser.

An annular ribbon seal 115 is located adjacent the lower edge of cap 124 and surrounds the upper end of neck 112 to provide a releasable seal for cap 124. In use, ribbon seal 115 is peeled off from the cap 124 to allow the cap 124 to be unthreaded from the top of neck 112. This opens the top opening of the container 110.

The cylindrical body 111 has a first or side handle 117 spanning a recess 122. Handle 117 is in alignment with a vertical longitudinal plane that extends through a longitudinal central axis of the container 110. Recess 122 has a general convex shape and is of a size to accommodate four fingers of a person's hand. Handle 117 is normally in a generally vertical direction and extends from adjacent the neck 112 to about the mid-section of the cylindrical body 111.

The base 113 has a second or bottom handle 118. The lower surface of handle 118 is in alignment with base 113 so that the container 110 can firmly and squarely rest on a horizontal flat support surface, such as a retail display shelf. Handle 118 spans a upwardly concave shaped recess 123 that extends diametrically across the base 113. As shown in FIG. 13, handle 118 is located diametrically across the middle of recess 123. Handle 123 is located in a plane that extends along the longitudinal axis of container 110. The plane of handle 118 is the same as the plane of the handle 117. Handle 118 is located in a 90 degree relationship relative to handle 117.

The cylindrical body 111 has a pair of annular grooves 119 and 120 located between the handles 117 and 118. The grooves 119 and 120 are recessed bands that reinforce the lower portion of cylindrical body 112. Each groove has a inwardly tapered annular side wall joined to a cylindrical base wall or band. A second pair of grooves 126 and 127 have a generally V-shaped configuration and an arcuate extent of about 200 degrees. They extend from opposite sides of recess 122 around the upper portion of cylindrical body 111. The mid-section of the cylindrical body 111 opposite handle 117 has a plurality of arc grooves 128, 129, 130, and 131. Each of these grooves 128–131 have a generally V-shaped configuration and an arcuate extent of about 90 degrees. The side of the cylindrical body 110 opposite handle 117 has a generally rib appearance providing the cylindrical body with a novel ornamental appearance as well as structural rigidity.

While there is shown and described several embodiments of the containers for the liquid dispenser and coolers of the invention, it is understood that changes in the sizes, shapes, materials, and configurations may be made by one skilled in the art without departing from the invention. The invention is defined in the following claims.

The embodiments of the invention in which an exclusive property or privilege is claimed are defined as follows:

1. A container for storing a liquid and a liquid dispenser accommodating said container comprising:

a liquid dispenser having a top wall with an opening, wall means providing a well below the top wall for accommodating a liquid, annular seal means mounted on said top wall surrounding said opening, and means operable to allow liquid to flow from said well; container means for storing said liquid, said container means comprising a one-piece bottle made of disposable flexible plastic material, said bottle having an annular side wall, a base joined to the side wall, and a neck joined to the side wall, said neck having an opening allowing the liquid in the container means to flow out of the container means into the well, said neck having annular flexible shoulder means located in surface sealing engagement with the annular seal means when the container means is located on said dispenser and the neck projects into the well whereby the liquid in the container means flows into the well, said shoulder being flexed into sealing conformity with the configuration of the annular seal means, said side wall having a first generally upright handle adapted to be gripped by one hand of a person, said base having a second handle adapted to be gripped by the other hand of a person whereby the container means can be lifted and inverted in operative relationship with said dispenser means, said first handle being in transverse alignment with said side wall, said side wall having a first recess means extended under the first handle, and said base having a second recess means extended over the second handle, said second handle being in transverse alignment with said base so as to not interfere with resting of the container means on a flat surface.

2. The structure of claim 1 wherein: said side wall has at least one groove located between the first and second handles, said groove extended around said side wall.

3. The structure of claim 1 wherein: said side wall has a plurality of grooves located between the first and second handles, said plurality of grooves extended around said side wall.

4. The structure of claim 1 wherein: said side wall has a plurality of arcuate grooves opposite the first handle.

5. The structure of claim 4 wherein: said side wall includes at least one groove located between the first and second handles, said at least one groove extended around said side wall.

6. The structure of claim 1 wherein: said neck has a generally conical shape, said shoulder joining said neck to said side wall.

7. The structure of claim 1 wherein: said container means has a longitudinal axis, and said first and second handles are normally disposed relative to each other and located in a plane extended through the longitudinal axis of the container means.

8. A container for storing a liquid and a liquid dispenser accommodating said container comprising: a liquid dispenser having a top wall with an opening, means providing a well located below said top wall for accommodating a liquid, annular seal means mounted on said top wall surrounding said opening, and means operable to allow liquid to flow from said well; container means for storing said liquid, said container means having side wall means surrounding a chamber for accommodating said liquid, a base joined to the side wall means, and a neck joined to the side wall means, said neck having an opening allowing the liquid in the container means to flow out of the container means into the well, said neck having an annular flexible shoulder means located in surface sealing engagement with the annular seal means when the container means is mounted on said dispenser and the neck projects into the well whereby liquid in the container means flows into the well, said containr means having handle means comprising a first generally upright handle located in transverse alignment with the side wall means adapted to be gripped by one hand of a person, and a second handle having a lower surface in alignment with said base adapted to be gripped by the other hand of the person whereby the container means can be moved to assembled relation with the dispenser means, said shoulder means being flexed into sealing conformity with the configuration of the annular seal means to retain the container means in assembled relation with said dispenser means.

9. The structure of claim 8 wherein: said side wall means includes at least one groove located adjacent said handle means, said groove extended around said side wall means.

10. The structure of claim 8 wherein: said side wall means has a plurality of grooves located adjacent said handle means, said plurality of grooves extended around said side wall means.

11. The structure of claim 10 wherein: said wall means has a plurality of arcuate grooves opposite the handle means.

12. The structure of claim 8 wherein: said wall means, base and neck are made of disposable plastic material, said shoulder being flexible to conform to the configuration of the seal means.

13. The structure of claim 8 wherein: said base has a recess extended over the second handle.

14. The structure of claim 8 wherein: said side wall means includes a recess extended under said first handle.

15. A container for storing liquid in a liquid dispenser accommodating said container comprising: a liquid dispenser having a top wall with an opening, wall means providing a well below the top wall for accommodating a liquid, annular seal means mounted on said wall surrounding said opening, and means operable to allow liquid to flow from said well; container means for storing said liquid, said container means comprising a one-piece bottle made of disposable flexible plastic material, said bottle having an annular side wall, a base joined to the side wall, and a neck joined to the side wall, said neck having an opening allowing the liquid in the container means to flow out of the container means into the well, said neck having an annular flexible shoulder located in surface sealing engagement with the annular seal means when the container means is located on said dispenser and the neck projects into the well whereby the liquid in the container means flows into the well, said container means having handle means comprising a first generally upright handle located in transverse alignment with the side wall adapted to be gripped by one hand of a person, and a second handle having a lower surface in alignment with said base adapted to be gripped by the other hand of the person whereby the container can be moved into operative relationship with said dispenser means, said shoulder being flexed into sealing conformity with the configuration of the annular seal means to retain the container means in assembled relation with said dispenser means.

16. The structure of claim 15 wherein: said side wall has at least one groove located around said side wall.

17. The structure of claim 15 wherein: said side wall has a plurality of grooves located around said side wall.

18. The structure of claim 15 wherein: said side wall has a plurality of arcuate grooves and at least one groove located around said side wall.

19. The structure of claim 15 wherein: said side wall includes at least one groove having a circumferential extent greater than 180 degrees.

20. A container for storing liquid in a liquid dispenser accommodating said container comprising: a liquid dispenser having a top wall with an opening, means providing a well below the top wall for accommodating a liquid, annular seal means mounted on said top wall surrounding said opening, and means operable to allow liquid to flow from said well; container means for storing said liquid, said container means having a side wall, a base joined to the side wall, and a neck joined to the side wall, said side wall, base and neck surrounding a chamber for storing said liquid, said neck having an opening allowing the liquid in the chamber to flow out of the chamber into the well when the neck extends downwardly into said well, said neck having an annular flexible shoulder located in surface sealing engagement with the annular seal means when the container means is supported on said annular seal means whereby the liquid in the container flows into the well, said shoulder being flexed into sealing conformity with the configuration of the annular seal means to retain the container means in assembled relation with said dispenser means, said side wall of the container means having first means adapted to be gripped by one hand of a person, said base having second means adapted to be gripped by the other hand of a person whereby the container can be moved with both hands of a person into operative relation with said dispenser means to locate the shoulder in surface sealing engagement with the annular seal means.

21. The container of claim 20 wherein: said side wall has at least one groove located in said side wall.

22. The container of claim 20 wherein: said side wall has a plurality of grooves circumferentially located in said side wall.

23. The container of claim 20 wherein: said side wall has a plurality of arcuate grooves and at least one circumferential groove located in said side wall.

24. The container of claim 20 wherein: said side wall includes at least one groove having a circumferential extent greater than 180 degrees.

* * * * *